US009113767B1

(12) United States Patent
Hensel

(10) Patent No.: US 9,113,767 B1
(45) Date of Patent: Aug. 25, 2015

(54) WINDOW CLEANING TOOL

(71) Applicant: Tyler Hensel, Oceanside, CA (US)

(72) Inventor: Tyler Hensel, Oceanside, CA (US)

( * ) Notice: Subject to any disclaimer, the term of this patent is extended or adjusted under 35 U.S.C. 154(b) by 0 days.

(21) Appl. No.: 14/527,451

(22) Filed: Oct. 29, 2014

(51) Int. Cl.
*A47L 1/06* (2006.01)
*A47L 1/15* (2006.01)
*A47L 13/11* (2006.01)

(52) U.S. Cl.
CPC . *A47L 13/11* (2013.01); *A47L 1/06* (2013.01); *A47L 1/15* (2013.01)

(58) Field of Classification Search
CPC ..... A47L 1/06; A47L 1/15; A47L 13/11
See application file for complete search history.

(56) References Cited

U.S. PATENT DOCUMENTS 1,493,507 A * 5/1924 Vitrone ..... 15/103
3,001,218 A * 9/1961 Tarney ..... 15/103
3,080,592 A * 3/1963 Hassage ..... 15/98

* cited by examiner

*Primary Examiner* — Randall Chin
(74) *Attorney, Agent, or Firm* — Snow Christensen & Martineau; Christopher L. Wight

(57) ABSTRACT

A window cleaning tool provides both a scrubbing pad and squeegees. Multiple squeegee blades are mounted to a squeegee roller. A wiper bar is disposed adjacent the squeegee roller to clean the squeegee blades. A trigger is mounted adjacent a handle and connected to the squeegee roller such that movement of the trigger rotates the squeegee roller and simultaneously cleans dirty squeegee blades while presenting a clean squeegee blade for use.

4 Claims, 2 Drawing Sheets

WINDOW CLEANING TOOL

PRIORITY

The present application claims the benefit of U.S. Provisional Application Ser. No. 61/285,158, filed Dec. 9, 2009, which is herein incorporated by reference in its entirety.

THE FIELD OF THE INVENTION

The present invention relates to window cleaning. More specifically, the present invention relates to an improved squeegee for cleaning windows.

BACKGROUND

A considerable amount of time and effort is spent cleaning windows. This is particularly true for commercial buildings where a clean building appearance will help to attract customers. Commercial buildings typically have a large number of windows and often the windows are quite tall.

When cleaning windows, a large amount of time is often spent raising and lowering the cleaning tool. Raising and lowering the tool is necessary to switch between a scrubbing tool to wash the window and a squeegee tool to dry the window as well as to dry the squeegee blade with a towel while drying the windows.

There is a need for a window cleaning tool which makes it easier to clean windows and which improves the cleanliness of the windows. Specifically, there is a need for a tool which eliminates the need for frequently raising and lowering the tool during use, and which maintains a clean squeegee edge during use.

SUMMARY OF THE INVENTION

It is an object of the present invention to provide an improved window cleaning tool.

According to one aspect of the invention, a window cleaning tool is provided which includes both a squeegee and a scrubbing head on the same tool. Including both a scrubbing head and a squeegee on the tool allows a person to scrub the window and then squeegee the cleaning solution off of the window without changing tools. The person may then carry a single cleaning tool in place of two tools.

According to another aspect of the invention, a window cleaning tool is provided which includes a squeegee cleaning strip and which allows the squeegees to be cleaned without lowering the tool. A squeegee roller is provided with multiple squeegees mounted thereto. The roller is rotated by moving a lever or grip adjacent the handle, and rotating the squeegee roller moves the squeegee blades across the cleaning strip to clean and dry the squeegee blades. This allows the user to clean the squeegee blades without lowering the tool.

These and other aspects of the present invention are realized in a window cleaning tool as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
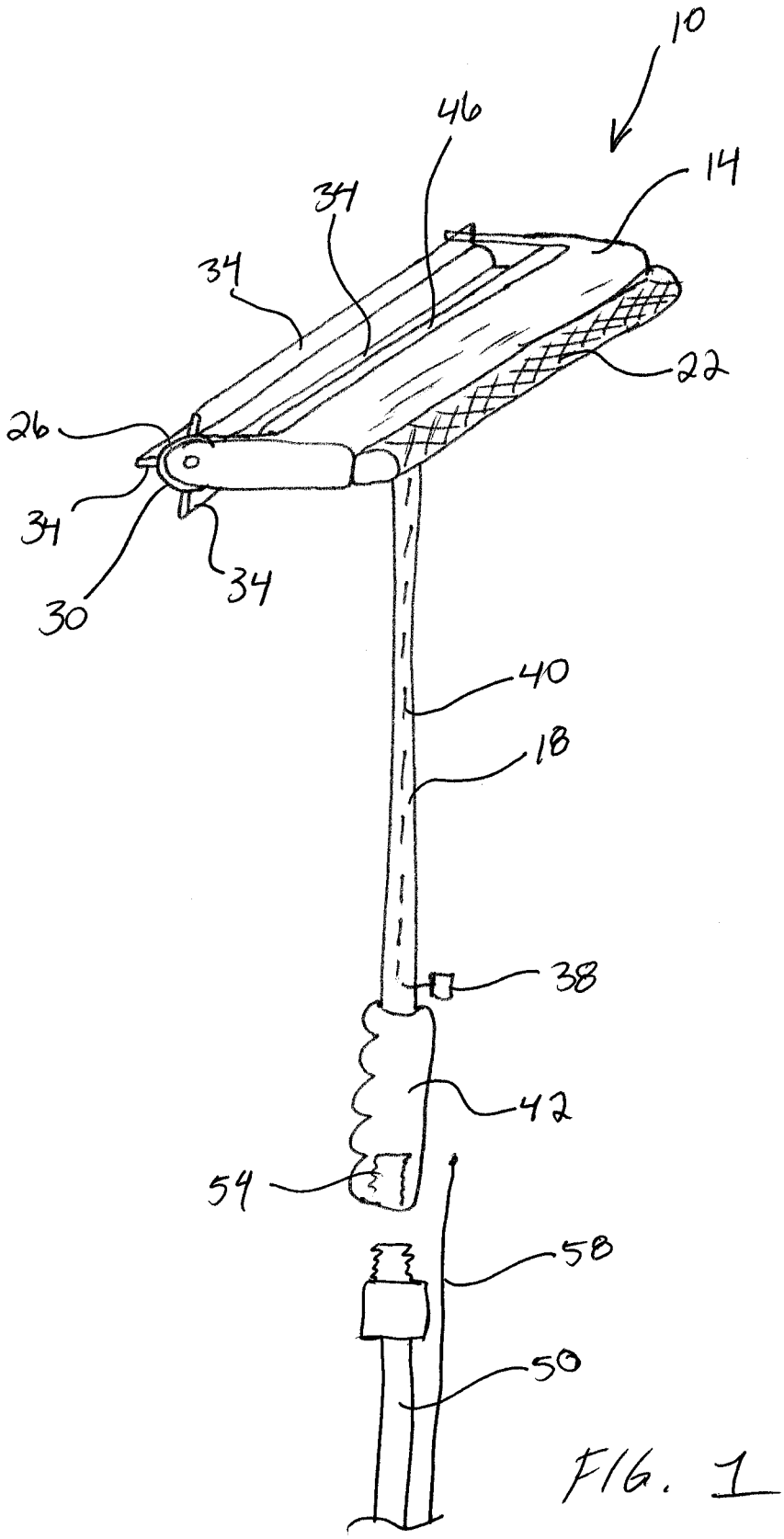
FIG. 1 shows a perspective view of a window cleaning tool of the present invention.

Turning now to FIG. 1, a perspective view of a window cleaning tool 10 is shown. The tool 10 includes a cleaning head 14 and a handle 18. The head 14 includes both a scrubbing pad 22 as well as a squeegee roller 26 so as to enable a person to both scrub and wipe a window with the same tool. The scrubbing pad is typically a mesh covered pad as are desirable for cleaning windows.

The squeegee roller 26 includes a roller body 30 and a plurality of squeegee blades 34. Four squeegee blades are shown. The roller 26 may be rotated during use by moving a trigger lever 38 mounted adjacent the handle grip 42. The trigger lever 38 is connected to an actuator rod 40 which extends up the inside of the handle 18 and actuates the roller 26. The use of the squeegee roller 26 allows the user to clean the squeegees without lowering the tool to wipe the squeegee blade with a towel as is commonly done. The head 14 has a wiper bar 46 mounted so as to contact the squeegee blades 34 when these are rotated. The wiper bar 46 is typically a foam that removes dirt and cleaning solution from the squeegee blade 34 so that the squeegee blade is clean and ready for use.

A handle extension 50 may be attached to a socket 54 in the handle 18. The handle extension 50 includes an actuator rod extension 58 that connects to the trigger lever 38. As such, the squeegee roller 26 may still be operated remotely and the user can clean the squeegee blades 34 without lowering the tool 10.

Figure 2:
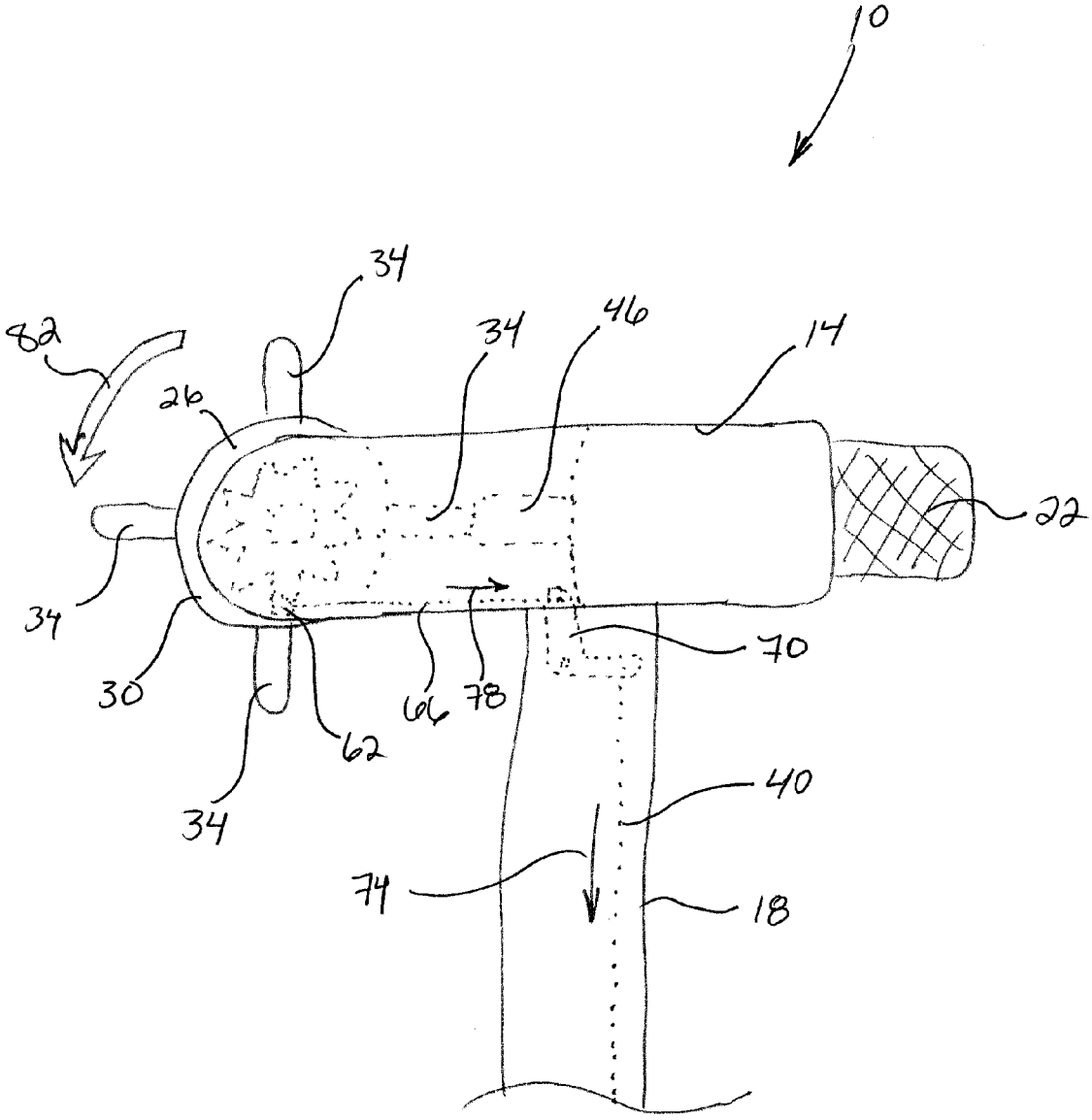
FIG. 2 shows a side view of the head of the tool of FIG. 1.

FIG. 2 shows a side view of the head 14 and shows additional details of the squeegee roller 26. The actuator rod 40 moves up the handle 18 and is connected to a pawl 62 via rod 66 and bell crank 70. Moving the trigger lever 38 moves the actuator rod 40 as shown by arrow 74, moving rod 66 as shown by arrow 78 and rotates the squeegee roller 26 by a specified amount (such as 90 degrees for a roller 26 with four squeegee blades 34) as shown by arrow 82. This moves a dirty squeegee blade 34 away from the front of the head 14 and moves a clean squeegee blade to the front of the head 14 where it is presented for use. The dirty squeegee blades 34 are moved across the wiper bar 46 to remove dirt and cleaning solution and prepare the blades 34 for use.

The window cleaning tool 10 is advantageous as it allows a user to scrub a window with the scrubbing pad 22 and then wipe clean the window with the squeegee roller 26 without changing tools or lowering the tool to clean the squeegee blades 34. A simple movement of the trigger lever will present a clean squeegee blade 34 and clean the dirty squeegee blades 34. The tool 10 thus allows the windows to be cleaned faster while promoting better work as the user may always have a clean squeegee blade without added delay.

There is thus disclosed an improved window cleaning tool. It will be appreciated that numerous changes may be made to the present invention without departing from the scope of the claims.

What is claimed is:

1. A window cleaning tool comprising:

a cleaning head;

a squeegee roller attached to the cleaning head, the squeegee roller having a plurality of squeegee blades attached thereto;

a wiper bar attached to the cleaning head; and a trigger for rotating the squeegee roller so as to move dirty squeegee blades across the wiper bar and thereby clean the dirty squeegee blades while simultaneously presenting a clean squeegee blade for use.

2. The tool of claim 1, further comprising a scrubbing pad attached to the cleaning head.

3. The tool of claim 2, further comprising a handle attached to the cleaning head.

4. The tool of claim 3, wherein the trigger comprises a trigger lever and wherein the trigger lever is connected to a pawl and wherein the squeegee roller is connected to a gear such that movement of the trigger lever moves the pawl and thereby rotates the gear to rotate the squeegee roller.

* * * * *